US009175889B2

(12) United States Patent
Ueda

(10) Patent No.: US 9,175,889 B2
(45) Date of Patent: Nov. 3, 2015

(54) HEAT SOURCE SYSTEM AND CONTROL METHOD THEREOF

(75) Inventor: Kenji Ueda, Aichi (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 426 days.

(21) Appl. No.: 12/988,664

(22) PCT Filed: Aug. 20, 2009

(86) PCT No.: PCT/JP2009/064572
§ 371 (c)(1),
(2), (4) Date: Oct. 20, 2010

(87) PCT Pub. No.: WO2010/024178
PCT Pub. Date: Mar. 4, 2010

(65) Prior Publication Data

US 2011/0030405 A1 Feb. 10, 2011

(30) Foreign Application Priority Data

Aug. 29, 2008 (JP) ..... 2008-221255

(51) Int. Cl.
*F25B 29/00* (2006.01)

(52) U.S. Cl.
CPC ..... *F25B 29/003* (2013.01); *F25B 2339/047* (2013.01)

(58) Field of Classification Search
CPC ..... F25B 29/003; F25B 2339/047
USPC ..... 62/238.6, 238.7, 335, 175; 237/2 B
See application file for complete search history.

(56) References Cited

U.S. PATENT DOCUMENTS

| | | | | |
|---|---|---|---|---|
| 4,252,751 | A * | 2/1981 | Shito | 261/26 |
| 5,241,829 | A * | 9/1993 | Irie et al. | 62/79 |
| 2004/0069448 | A1 * | 4/2004 | Suenaga et al. | 165/47 |
| 2007/0246555 | A1 | 10/2007 | Nishimura et al. | |

FOREIGN PATENT DOCUMENTS

| | | | |
|---|---|---|---|
| JP | 62-049160 | A | 3/1987 |
| JP | 3-61262 | U | 6/1991 |
| JP | 2005-114295 | A | 4/2005 |
| JP | 2005-315433 | A | 11/2005 |
| JP | 2006-023049 | A | 1/2006 |

OTHER PUBLICATIONS

International Search Report of PCT/JP2009/064572, mailing date Nov. 17, 2009.
Decision to Grant a Patent issued on Feb. 4, 2014 in Japanese Patent Application No. 2008-221255 (3 pages).

* cited by examiner

*Primary Examiner* — Cassey D Bauer
(74) *Attorney, Agent, or Firm* — Westerman, Hattori, Daniels & Adrian, LLP

(57) ABSTRACT

An object is to provide a heat source system capable of realizing energy saving. In a heat source system including: a chilled-water main control heat pump (1) having a lower-stage evaporator (9) that cools chilled water and a lower-stage condenser (7) that dissipates heat into cooling water, and outputting the chilled water cooled in the lower-stage evaporator (9) to an external load; and a hot-water main control heat pump (51) having a higher-stage evaporator (59) to which heat is provided by medium-temperature water that has been heated with the exhaust heat from the lower-stage condenser (7) and a higher-stage condenser (57) that heats high-temperature water, and outputting the high-temperature water heated in the higher-stage condenser (57) to an external load; a lower temperature limit of the cooling water is set on the basis of a set temperature of the high-temperature water.

10 Claims, 7 Drawing Sheets

HEAT SOURCE SYSTEM AND CONTROL METHOD THEREOF

TECHNICAL FIELD

The present invention relates to a heat source system and a control method thereof.

BACKGROUND ART

A heat source system for enabling the supply of chilled water of a constant temperature is provided in a factory equipped with a semiconductor fabrication facility or the like (for example, a clean room). As the heat source system, there is one equipped with a plurality of centrifugal chillers, as shown in PTL 1, for example.

In factories equipped with semiconductor fabrication facilities, high-temperature water of approximately 60 to 70° C. that is used as cleaning water in the semiconductor fabrication facility and medium-temperature water of approximately 32 to 45° C. for heating are required in addition to the chilled water.

Conventionally known heat source systems that supply such high-temperature water and medium-temperature water include, as shown in FIG. 7, those in which a boiler 129 is combined with a centrifugal chiller 101.

As shown in FIG. 7, the centrifugal chiller 101 is driven by an electric motor 103 and is equipped with a centrifugal compressor 105 that compresses refrigerant, a condenser 107 that condenses the refrigerant compressed by the centrifugal compressor 105, an expansion valve (not shown) that expands the refrigerant condensed by the condenser 107, and an evaporator 109 that evaporates the refrigerant expanded by the expansion valve.

The evaporator 109 is connected to chilled water piping 110, through which the chilled water flows, and the chilled water is cooled by the latent heat of evaporation of the refrigerant that is evaporated in the evaporator 109. The chilled water piping 110 is provided with a chilled water pump 112, and the chilled water is supplied in a circulating manner by this chilled water pump 112 between the evaporator 109 and external loads (not shown) that use the chilled water, such as the semiconductor fabrication facilities.

The condenser 107 is connected to cooling water piping 114, through which cooling water flows, and the latent heat of condensation of the refrigerant condensed in the condenser 107 is dissipated to the cooling water. The cooling water piping 114 is provided with a cooling water pump 116, and the cooling water is supplied in a circulating manner between a cooling tower 118 and the condenser 107 by this cooling water pump 116. The cooling tower 118 is of the type in which the cooling water is cooled by being sprinkled into the outside air by a sprinkler 120 and is equipped with a fan 119 for cooling the sprinkled cooling water.

The cooling water piping 114 located between the condenser 107 and the cooling tower 118 is provided with a medium-temperature-water heat exchanger 121. This medium-temperature-water heat exchanger 121 is provided with medium-temperature-water piping 125 that guides the hot water supplied from a medium-temperature-water pump 123. The medium-temperature water that has passed through the medium-temperature-water piping 125 and that has received heat from the cooling water in the medium-temperature-water heat exchanger 121 is guided to medium-temperature-water supply piping 127, and is used as the heat source for heating.

In order to supply high-temperature water, in addition to the centrifugal chiller 101, the boiler 129 is provided. The boiler 129 is provided with high-temperature-water piping 132 that guides feed water supplied from a boiler water supply pump 130. The feed water circulating in the high-temperature-water piping 132 is heated in the boiler 129 and is guided to high-temperature-water supply piping 134 as high-temperature water of approximately 60 to 70° C. The high-temperature water supplied by the high-temperature-water supply piping 134 is used as a heat source of high-temperature cleaning water for the semiconductor facilities. The reference numeral 136 is back-up piping that connects the high-temperature-water piping 132 and the medium-temperature-water supply piping 127, and that is used for supplying the high-temperature water as a back-up for the medium-temperature water.

FIG. 8 shows a heat source system in which a heat-recovery machine is employed for the condenser 107 in FIG. 7. Specifically, in FIG. 8, the heat source system is configured such that the medium-temperature-water piping 125 is connected to the condenser 107, and heating is conducted by a medium-temperature-water heat exchanger (not shown) in the condenser 107, thereby obtaining heat from the condenser 107. Therefore, in the heat source system shown in FIG. 8, the medium-temperature-water heat exchanger 121 shown in FIG. 7 is omitted. Because the other configurations are the same as in the heat source system shown in FIG. 7, the same reference numerals are assigned and descriptions thereof are omitted.

CITATION LIST

Patent Literature

{PTL 1}
Japanese Unexamined Patent Application, Publication No. 2005-114295

SUMMARY OF INVENTION

Technical Problem

However, the method in which the boiler is used to obtain the high-temperature water, as in the related art shown in FIGS. 7 and 8, is not advisable in terms of energy efficiency. This is because, with the boiler that heats the feed water by the heat of combustion of fossil fuel, the efficiency becomes 1 or less, which is disadvantageous compared with the case using a heat pump. In other words, if a heat pump is used, it is possible to expect a COP of 3 or more and to contribute to energy saving, and even when converted into primary energy, the amount of CO2 emitted can be made less than that emitted with the boiler.

Therefore, in order to obtain the high-temperature water, it is believed to be advantageous to use a heat pump as a higher-stage of the heat source system. However, even if a heat pump is used at the higher-stage for obtaining the high-temperature water, in order to achieve further energy saving, it is necessary to consider the energy saving of the overall heat source system combined with a chiller at a lower-stage for obtaining the chilled water.

The present invention has been conceived in light of such a situation, and an object thereof is to provide a heat source system that is capable of realizing further energy saving and a control method thereof.

Solution to Problem

In order to solve the problems described above, the heat source system and the control method thereof of the present invention employ the following solutions.

Specifically, a heat source system according to one aspect of the present invention includes a chilled-water main control heat pump having a lower-stage evaporator that cools chilled water by the vaporization heat of refrigerant and a lower-stage condenser that dissipates the condensation heat of the refrigerant into cooling water, and outputting the chilled water cooled in the lower-stage evaporator to an external load; and a hot-water main control heat pump having a higher-stage evaporator that evaporates the refrigerant with the heat provided from medium-temperature water that has been heated with the exhaust heat from the lower-stage condenser and a higher-stage condenser that heats high-temperature water with the condensation heat of the refrigerant, and outputting the high-temperature water heated in the higher-stage condenser to an external load; a lower temperature limit of the cooling water being set on the basis of a set temperature of the high-temperature water.

Since the lower the cooling-water temperature is, the more efficiently the chilled-water main control heat pump can be operated, the cooling-water temperature is required to be as low as possible. On the other hand, with the hot-water main control heat-pump, there is a minimum evaporator-side temperature, in other words, a medium-temperature-water temperature required for outputting the high-temperature water of the required temperature. Thus, in order to ensure the medium-temperature-water temperature required to obtain the desired high-temperature-water temperature, a lower limit of the cooling-water temperature is provided such that the required amount of lower-stage condenser exhaust heat can be provided to the medium-temperature water. Therefore, the heat source system is operated at a cooling-water temperature that does not become lower than the lower-limit value. Thus, in the present invention, since the lower temperature limit of the cooling water is set on the basis of the set temperature of the high-temperature water, even when low cooling-water temperature is required by the chilled-water main control heat-pump, this request is restricted, and by ensuring the medium-temperature water of the desired temperature, the high-temperature water of the desired temperature can be output to the external load by the hot-water main control heat-pump. In other words, not only is it possible to obtain the high-temperature water and chilled water of the desired temperature, but it is also possible to achieve both a medium-temperature-water temperature that is efficient for the hot-water main control heat pump and a cooling-water temperature that is efficient for the chilled-water main control heat-pump, and to realize high energy efficiency of the heat source system as a whole.

More specifically, the lower temperature limit of the cooling water is the minimum required temperature that is capable of realizing the required high-temperature-water temperature by the hot-water main control heat-pump.

The medium-temperature water may receive the exhaust heat indirectly by a medium-temperature-water heat exchanger for exchanging heat with the cooling water that has received the exhaust heat from the lower-stage condenser, or it may receive the exhaust heat directly from the medium-temperature-water heat exchanger provided in the lower-stage condenser (a so-called heat-recovery machine).

The chilled water is, for example, approximately 5 to 10° C. and is used as cooling water for a semiconductor fabrication facility or is used for air-conditioning in a factory (for example, clean room) in which a semiconductor fabrication facility is installed.

The high-temperature water is, for example, approximately 60 to 70° C., and is used for heating cleaning water for the semiconductor fabrication facility.

It is preferable to use, for example, a centrifugal chiller equipped with a centrifugal compressor as the chilled-water main control heat pump and the hot-water main control heat pump.

The numbers of chilled-water main control heat pumps and hot-water main control heat pumps are not limited to one, and the heat source system may be equipped with a plurality of each.

Although the condenser of the chilled-water main control heat pump is described as "lower-stage condenser" and the condenser of the hot-water main control heat pump is described as "higher-stage condenser", this is because the temperature of the medium (water) to be output to external loads is lower for the chilled-water main control heat pump than that for the hot-water main control heat pump and is merely described as "lower-stage" for convenience of distinction; the description is not intended to be limited any further than that. Therefore, the relation between "lower-stage evaporator" and "higher-stage evaporator" is the same, and the terms "lower-stage" and "higher-stage" are used in this specification with the same meanings.

The heat source system according to one aspect of the present invention further includes medium-temperature-water output means that outputs the medium-temperature water to the external load, and an operating temperature of the cooling water is set within a medium-temperature water set temperature range that is required by the medium-temperature-water output means.

The medium-temperature water is output outside the heat source system by the medium-temperature-water output means. The medium-temperature water is, for example, approximately 32 to 45° C. and is used for heating a factory (for example, clean room) in which the semiconductor fabrication facility is provided.

Since the medium-temperature water is heated with the exhaust heat of the condenser, there is a large dependence on the temperature of the cooling water removing the exhaust heat of the lower-stage condenser. Thus, by setting the operating temperature so as to satisfy the set temperature range of the medium-temperature water required, and by operating at a temperature higher than the lower temperature limit of the cooling water, it is possible to output not only the medium-temperature water but also the high-temperature water in the desired temperature range.

Therefore, even if the cooling water operating temperature required by the chilled-water main control heat pump and the cooling water operating temperature required by the hot-water main control heat pump match, this operating temperature will not be used unless this operating temperature falls within the medium-temperature water set temperature range, and the operating temperature is set to the cooling-water temperature within the medium-temperature water set temperature range, such that both heat pumps can be operated at the highest efficiency (for example, so as to be operated with the least power consumption).

With the heat source system according to one aspect of the present invention, when there is no output-request to the medium-temperature-water output means, the operating temperature of the cooling water is set regardless of the medium-temperature water set temperature range.

If there is no output-request for medium-temperature water, there is no need to consider the set temperature range of the medium-temperature water, and therefore, efficient operation can be realized by setting the operating temperature of the cooling water regardless of the medium-temperature water set temperature range (i.e., even outside the medium-temperature water set temperature range).

With the heat source system according to one aspect of the present invention, the operating temperature of the cooling water is set such that the sum of power consumed by the chilled-water main control heat pump and power consumed by the hot-water main control heat pump becomes substantially the minimum.

In the case where the quantity of heat required for the chilled water is large, like in summer time, the thermal load (in turn, the power consumption) of the chilled-water main control heat pump becomes greater compared with the hot-water main control heat pump. In this case, it is preferable to suppress the power consumption of the chilled-water main control heat pump by decreasing the cooling-water temperature.

On the other hand, in the case where the quantity of heat required for the chilled water is small, like in winter time, the thermal load (in turn, the power consumption) of the chilled-water main control heat pump becomes smaller, and there is a case where the power consumption of the hot-water main control heat pump becomes rather large. In this case, it is preferable to suppress the power consumption of the hot-water main control heat pump by increasing the cooling-water temperature.

Thus, the operating temperature of the cooling water is set by considering the sum of the power consumptions of the chilled-water main control heat pump and the hot-water main control heat pump, thereby realizing energy-saving operation of the heat source system as a whole.

The heat source system according to one aspect of the present invention further includes a cooling tower that cools the cooling water by sprinkling the cooling water into outside air, and the cooling tower has cooling-water-temperature adjusting means that adjusts the cooling-water temperature.

The cooling-water temperature is set to the desired temperature by the cooling-water-temperature adjusting means provided in the cooling tower.

The cooling-water-temperature adjusting means includes, for example, rotation speed variable control means that variably controls the rotation speed of a fan that cools the cooling water; fan ON/OFF control means that controls the fan ON/OFF; a control valve that adjusts the flow rate of the cooling water that bypasses a heat-exchanger (sprinkler), in which the cooling water is cooled by the fan; flow rate control means that controls the flow rate at the cooling water pump that supplies the cooling water; and so forth.

In a control method of a heat source system according to one aspect of the present invention that includes a chilled-water main control heat pump having a lower-stage evaporator that cools chilled water by the vaporization heat of refrigerant and a lower-stage condenser that dissipates the condensation heat of the refrigerant into cooling water, and outputting the chilled water cooled in the lower-stage evaporator to an external load; and a hot-water main control heat pump having a higher-stage evaporator that evaporates the refrigerant with the heat given from medium-temperature water that has been heated with the exhaust heat from the lower-stage condenser and a higher-stage condenser that heats high-temperature water with the condensation heat of the refrigerant, and outputting the high-temperature water heated in the higher-stage condenser to an external load, a lower temperature limit of the cooling water is set on the basis of a set temperature of the high-temperature water.

Since the lower the cooling-water temperature is, the more efficiently the chilled-water main control heat pump can be operated, the cooling-water temperature is required to be as low as possible. On the other hand, with the hot-water main control heat-pump, there is a minimum evaporator-side temperature, in other words, a medium-temperature-water temperature required for outputting the high-temperature water of the required temperature. Thus, in order to ensure the medium-temperature-water temperature required to obtain the desired high-temperature-water temperature, a lower limit of the cooling-water temperature is provided such that the required amount of lower-stage condenser exhaust heat can be provided to the medium-temperature water. Therefore, the heat source system is operated at a cooling-water temperature that does not become lower than the lower-limit value. Thus, in the present invention, since the lower temperature limit of the cooling water is set on the basis of the set temperature of the high-temperature water, even when a low cooling-water temperature is required by the chilled-water main control heat-pump, this request is restricted, and by ensuring the medium-temperature water of the desired temperature, the high-temperature water of the desired temperature can be output to the external load by the hot-water main control heat-pump. In other words, not only is it possible to obtain the high-temperature water and chilled water of the desired temperature, but it is also possible to achieve both a medium-temperature-water temperature that is efficient for the hot-water main control heat pump and a cooling-water temperature that is efficient for the chilled-water main control heat-pump, and to realize high energy efficiency of the heat source system as a whole.

Advantageous Effects of Invention

According to the heat source system and the control method thereof of the present invention, the lower temperature limit of the cooling water is set on the basis of the set temperature of the high-temperature water, and therefore, it is possible to realize a medium-temperature-water temperature that is efficient for the hot-water main control heat pump and a cooling-water temperature that is efficient for the chilled-water main control heat pump, and to realize high energy efficiency of the heat source system as a whole.

DESCRIPTION OF EMBODIMENTS

Embodiments according to the present invention will be described below with reference to the drawings.

Figure 1:
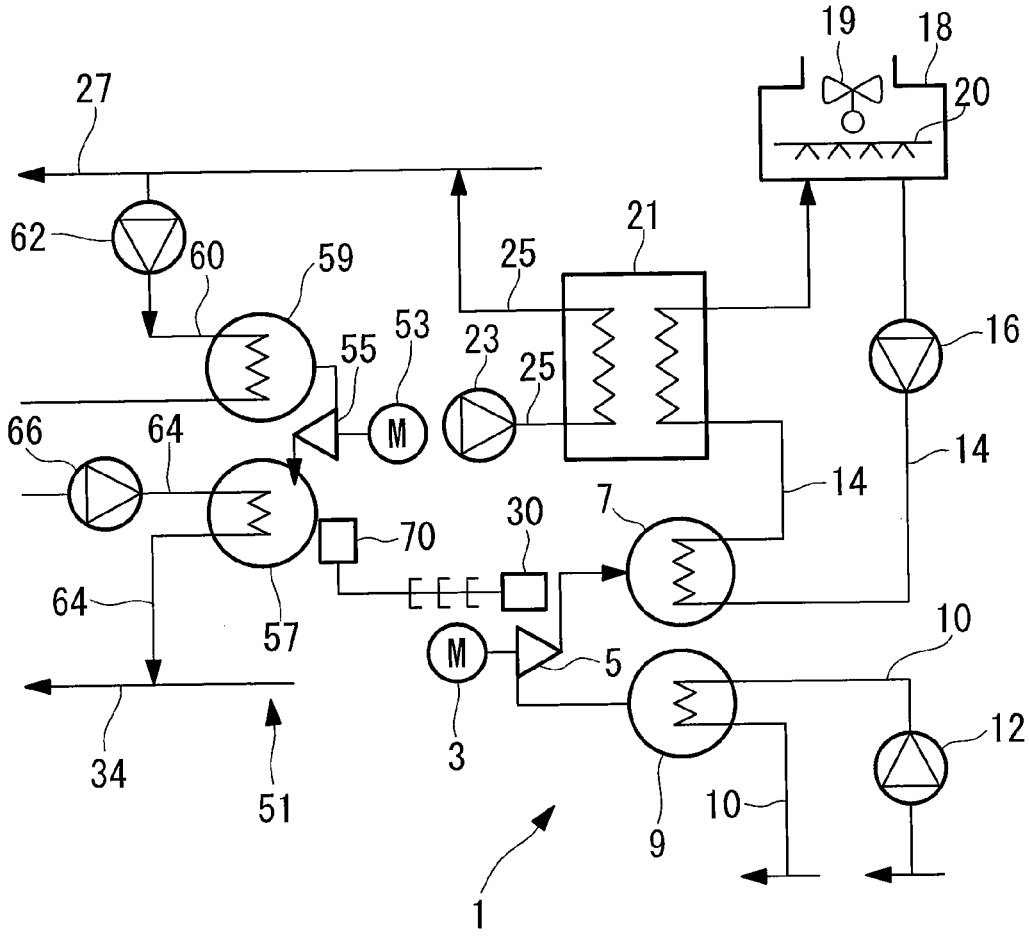
FIG. 1 is a schematic structural diagram showing a heat source system of the present invention.

As shown in FIG. 1, a heat source system is equipped with a chilled-water main control heat pump 1 provided at a lower stage and a hot-water main control heat pump 51 provided at a higher stage.

A centrifugal chiller (or a centrifugal heat pump) equipped with a centrifugal compressor is used in each of the heat pumps 1 and 51.

The chilled-water main control heat pump 1 is driven by an electric motor 3 that is controlled by a frequency-variable inverter and is equipped with a lower-stage centrifugal compressor 5 that compresses refrigerant, a lower-stage condenser 7 that condenses the refrigerant compressed by the lower-stage centrifugal compressor 5, a lower-stage expansion valve (not shown) that expands the refrigerant condensed by the lower-stage condenser 7, and a lower-stage evaporator 9 that evaporates the refrigerant expanded by the lower-stage expansion valve.

The lower-stage evaporator 9 is connected to chilled water piping 10, through which the chilled water flows, and the chilled water is cooled by the latent heat of evaporation of the refrigerant that is evaporated in the lower-stage evaporator 9. The chilled water piping 10 is provided with a chilled water pump 12, and the chilled water is supplied in a circulating manner by this chilled water pump 12 between the lower-stage evaporator 9 and the external loads (not shown) that use the chilled water, such as semiconductor fabrication facilities and so forth. The chilled water temperature is approximately 5 to 10° C.

The lower-stage condenser 7 is connected to cooling water piping 14, through which cooling water flows, and the latent heat of condensation of the refrigerant that is condensed in the lower-stage condenser 7 is dissipated to the cooling water. A cooling water pump 16 is provided at an intermediate point in the cooling water piping 14, and the cooling water is supplied in a circulating manner by this cooling water pump 16 between a cooling tower 18 and the lower-stage condenser 7. The cooling water pump 16 has a rotation speed that can be varied by a motor with an inverter and is capable of controlling the cooling-water temperature by suitably adjusting the cooling-water flow rate.

The cooling tower 18 is of the type in which the cooling water is cooled by being sprinkled into the air by a sprinkler 20, and is provided with a fan 19 for cooling the sprinkled cooling water. The fan 19 has a rotation speed that can be varied by a motor with an inverter and is capable of controlling the cooling-water temperature.

The cooling water pump 16 and the fan 19 are operated at the prescribed rotational speed according to instructions from a control unit (not shown) of the cooling tower 18.

In addition, cooling water bypass piping may be provided such that the cooling water bypasses the sprinkler 20, and the cooling-water temperature may be controlled by controlling the flow rate in this cooling water bypass piping.

The cooling water piping 14 between the lower-stage condenser 7 and the cooling tower 18 is provided with a medium-temperature-water heat exchanger 21. This medium-temperature-water heat exchanger 21 is provided with medium-temperature-water piping 25 that guides the hot water supplied from a medium-temperature-water pump 23. The medium-temperature water that has passed through the medium-temperature-water piping 25 and that has received heat from the cooling water in the medium-temperature-water heat exchanger 21 is guided to medium-temperature-water supply piping (medium-temperature-water output means) 27 and is used as a heat source for heating. The medium-temperature-water temperature is approximately 32 to 45° C.

A lower-stage control unit 30 that controls the operation of the chilled-water main control heat pump 1 is provided. The lower-stage control unit 30 controls, for example, the rotational speed of the electric motor 3, the degree of opening of inlet guide vanes (volume control valve) provided in the centrifugal compressor 5, and so forth such that the chilled water temperature is maintained at a set value. In addition, the lower-stage control unit 30 outputs an appropriate cooling-water temperature depending on the operational state to a control unit (not shown) of the cooling tower 18.

The hot-water main control heat pump 51 is driven by an electric motor 53 that is controlled by a frequency-variable inverter and is equipped with a higher-stage centrifugal compressor 55 that compresses the refrigerant, a higher-stage condenser 57 that condenses the refrigerant compressed by the higher-stage centrifugal compressor 55, a higher-stage expansion valve (not shown) that expands the refrigerant condensed by the higher-stage condenser 57, and a higher-stage evaporator 59 that evaporates the refrigerant expanded by the higher-stage expansion valve.

The higher-stage evaporator 59 is connected to medium-temperature-water introduction piping 60 that guides medium-temperature water from the medium-temperature-water supply piping 27. The medium-temperature water that is guided into the higher-stage evaporator 59 from this medium-temperature-water introduction piping 60 gives the latent heat of evaporation to the refrigerant to evaporate it. A medium-temperature-water pump 62 is provided at an intermediate point in the medium-temperature-water introduction piping 60, and some of the medium-temperature water is guided towards the higher-stage evaporator 59 by this medium-temperature-water pump 62 from the medium-temperature-water supply piping 27.

The higher-stage condenser 57 is connected to high-temperature-water piping 64, through which high-temperature water flows, and the high-temperature water is heated with the latent heat of condensation of the refrigerant that is condensed in the higher-stage condenser 57. A high-temperature-water pump 66 is provided at an intermediate point in the high-temperature-water piping 64, and the high-temperature water is supplied in a circulating manner by this high-temperature-water pump 66 between the condenser 57 and external loads (for example, a cleaning water heating part in a semiconductor fabrication device). The high-temperature-water temperature is approximately 60 to 70° C.

A higher-stage control unit 70 that controls the operation of the hot-water main control heat pump 51 is provided. The higher-stage control unit 70 controls, for example, the rotational speed of the electric motor 53, an aperture of inlet guide vanes (volume control valve) provided in the centrifugal compressor 55, and so forth such that the high-temperature-water temperature is maintained at the set value.

Mutual data communication between the higher-stage control unit 70 and the lower-stage control unit 30 is made possible. The higher-stage control unit 70 outputs, depending on the operational state, a required medium-temperature-water temperature that realizes the preset high-temperature-water temperature to the lower-stage control unit 30. However, as described below, the required medium-temperature-water temperature is set within the temperature range (for example from 32 to 45° C.) required by the external load conducting the heating.

The lower-stage control unit 30 receives the required medium-temperature-water temperature from the higher-stage control unit 70, calculates the higher-stage required cooling-water temperature that corresponds to the required medium-temperature-water temperature, and calculates the cooling-water temperature by taking account of this higher-stage required cooling-water temperature and the lower-stage required cooling-water temperature required by the chilled-water main control heat pump 1. The cooling-water temperature thus calculated is set as in the graph shown in FIG. 2.

Figure 2:
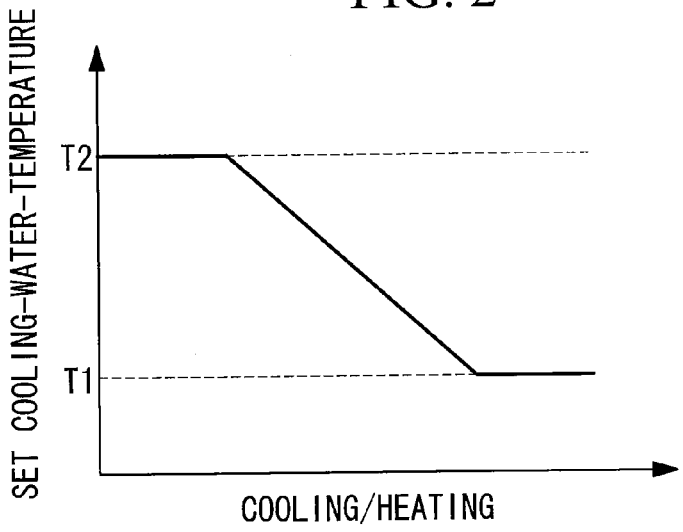
FIG. 2 is a graph showing a method for setting cooling-water temperature.

The horizontal axis in FIG. 2 is a percentage of the thermal load (cooling) of the chilled-water main control heat pump 1 relative to the thermal load (heat) of the hot-water main control heat pump 51, and is expressed as "cooling/heating". As the horizontal axis becomes larger, the percentage of cooling is increased, indicating the operation during the summer time, and as the horizontal axis becomes smaller, the percentage of heating is increased, indicating the operation during the winter time. The vertical axis in FIG. 2 indicates a set cooling-water temperature that is to be output by the lower-stage control unit 30 to a control unit (not shown) of the cooling tower 18.

As shown in FIG. 2, if the percentage of cooling is large, a lower temperature limit T1, which is a lower limit, is set for the set cooling-water temperature. The reason for providing the lower temperature limit T1 in this manner is as described below.

Since the lower the cooling-water temperature is, the more efficiently the chilled-water main control heat pump 1 can be operated, the cooling-water temperature is required to be as low as possible. Especially in the summer time, during which the percentage of cooling is large, a cooling-water temperature of approximately 11 to 13° C. is required. However, with the hot-water main control heat pump 51, there is the minimum saturation pressure (saturation temperature), which is the medium-temperature-water temperature of the higher-stage evaporator 59 required for outputting the high-temperature water of the required temperature (for example, from 60 to 70° C.). Thus, in order to ensure the medium-temperature-water temperature required to obtain the desired high-temperature-water temperature, it is necessary to provide a lower limit of the cooling-water temperature considering the capacity of the hot-water main control heat pump 51.

On the other hand, if the percentage of heating is large, the higher the cooling-water temperature is, the more efficiently the hot-water main control heat pump 51 can be operated. However, since there is a risk that a failure may be caused in the equipment if the cooling-water temperature is increased, an upper temperature limit T2, which is an upper limit, is set for the set cooling-water temperature.

In an intermediate region of "cooling/heating" between the lower temperature limit T1 and the upper temperature limit T2 of the cooling-water temperature, the cooling-water temperature is set in the following way.

Figure 3:
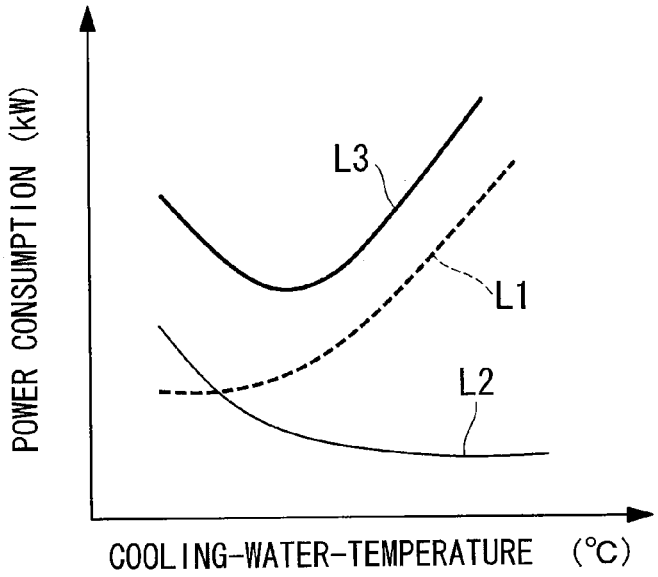
FIG. 3 is a graph showing the change in power consumption versus the cooling-water temperature.

Power consumption relative to the cooling-water temperature under a prescribed thermal load is shown in FIG. 3. Dotted line L1 shows the power consumption of the chilled-water main control heat pump 1, and thin solid line L2 shows power consumption of the hot-water main control heat pump 51. Thick solid line L3 shows the sum of the power consumption of each of the heat pumps 1 and 51.

As can be seen from the dotted line L1, in the chilled-water main control heat pump 1, even with the same thermal load, the lower the cooling-water temperature is, the higher the efficiency becomes and the lower the power consumption will be. On the other hand, as can be seen from the thin solid line L2, in the hot-water main control heat pump 51, even with the same thermal load, the higher the cooling-water temperature is, the higher the efficiency becomes and the lower the power consumption will be. Therefore, as can be seen from the thick solid line L3, there exists a cooling-water temperature with which the sum of the power consumptions of the heat pumps 1 and 51 becomes the minimum. The lower-stage control unit 30 calculates this cooling-water temperature that exhibits the minimum value of the sum of the power consumptions.

The dotted line L1 and the thin solid line L2 are provided in advance in accordance with a plurality of cooling load values and thermal load values and are stored in a memory of the lower-stage control unit 30 as a map or a numerical table.

Figure 4:
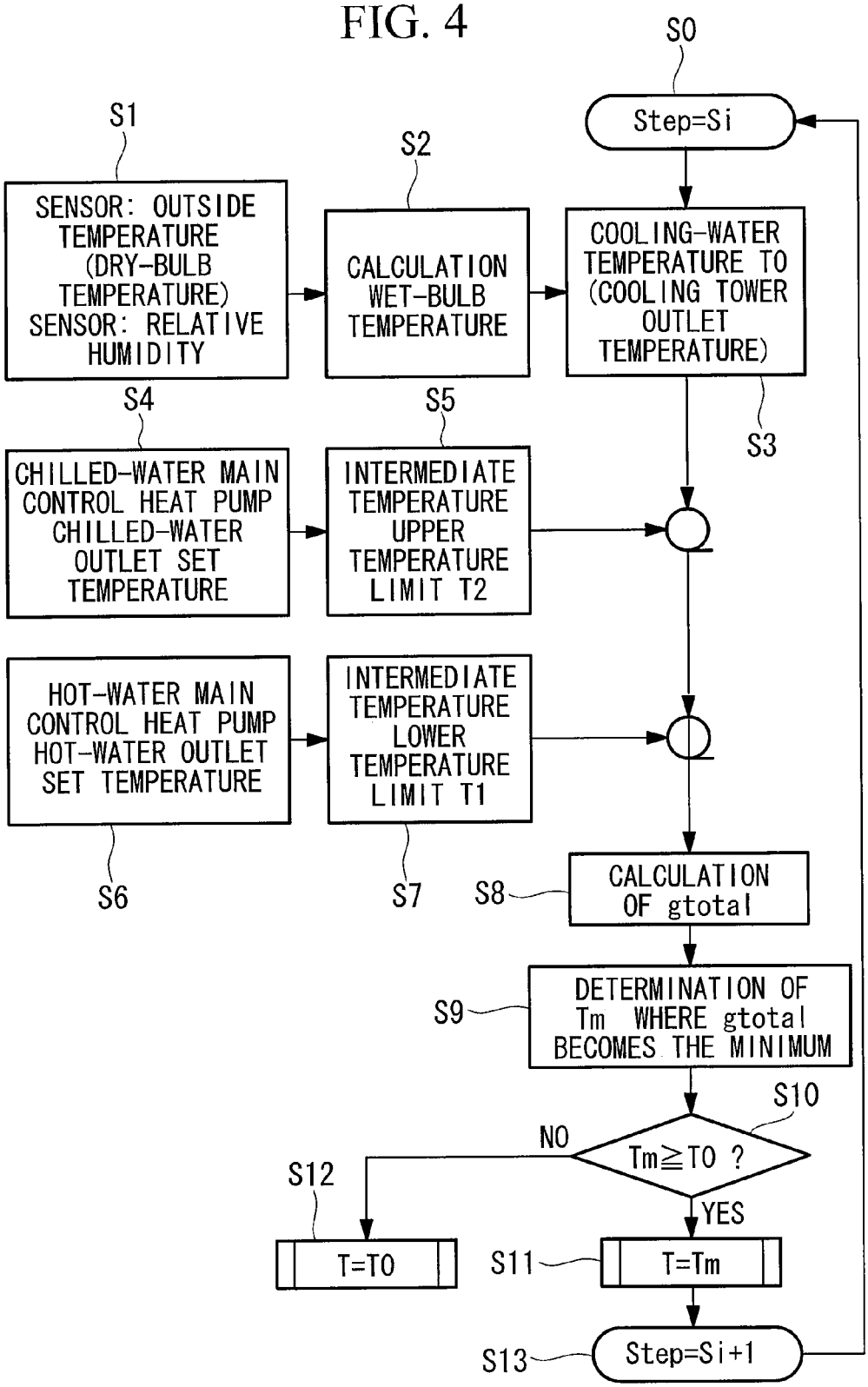
FIG. 4 is a flow chart showing a method for setting the cooling-water temperature for minimizing the power consumption.

In FIG. 4, a flow chart for calculating the cooling-water temperature that minimizes the power consumption is shown.

First, the cooling water temperature in time step Si at the present time is determined (step S0).

Since the cooling tower 18 is of the sprinkler type, from an outside temperature (dry-bulb temperature) sensor and a relative humidity sensor (step S1), a wet-bulb temperature is calculated (step S2), and a cooling-water temperature T0, which is an initial value, is calculated (step S3).

Next, from a chilled-water outlet set temperature of the chilled-water main control heat pump 1 (step S4), an upper temperature limit T2, which is the upper limit of the cooling-water temperature, is obtained (step S5). Similarly, from a hot-water outlet set temperature of the hot-water main control heat pump 51 (step S6), the lower temperature limit T1, which is the lower limit of the cooling-water temperature, is obtained (step S7).

Next, in the range from the lower temperature limit T1 to the upper temperature limit T2, the power consumption gl(T) of the chilled-water main control heat pump 1 and the power consumption gh(T) of the hot-water main control heat pump 51 are obtained at prescribed intervals of temperature T (for example, 1° C. pitch) and are stored in the memory of the lower-stage control unit 30.

The power consumption gl(T) of the chilled-water main control heat pump 1 is obtained as a quadratic equation of load factor xl, for example, using the load Ql of the chilled-water main control heat pump 1, as follows.

$$gl(xl,T)=\{al(T)\cdot xl^2+bl(T)\cdot xl+cl(T)\}\cdot Ql$$

Herein, the load factor xl means the ratio with respect to the rated load of the chilled-water main control heat pump 1 and is a value of approximately 0 to 1.2. In addition, coefficients such as al, bl, or cl are variables corresponding to each temperature T and are set in advance in accordance with an advance operation or design conditions.

Similarly, the power consumption gh(T) of the hot-water main control heat pump 51 is obtained as a quadratic equation of load factor xh, for example, using the load Qh of the hot-water main control heat pump 51, as follows.

$$gh(xh,T)=\{ah(T)\cdot xh^2+bh(T)\cdot xh+ch(T)\}\cdot Qh$$

Herein, the load factor xh means the ratio with respect to the rated load of the hot-water main control heat pump 51 and is a value of approximately 0 to 1.2. In addition, coefficients such as ah, bh, or ch are variables corresponding to each temperature T and are set in advance in accordance with an advance operation or a design condition.

Then, the total power consumption, gtotal(T), is obtained from the following equation (step S8).

$$\mathrm{gtotal}(T)=gl(xl,T)+gh(xh,T)$$

The result of the calculation with the above equation is stored in the memory of the lower-stage control unit 30. By comparing gtotal(T) for each temperature T using this calculation result, T=Tm (step S9) that achieves the minimum power consumption is determined. Next, the process proceeds to step 10, and if the obtained Tm is Tm≥T0, then T=Tm is taken as the optimal value (step S11). If Tm is Tm<T0, then T=T0 is taken as the optimal value (step S12). However, if T0<T1, then Tm is obtained from the range from T1 to T2, if T2<T0, Tm is obtained from the range from T1 to T2, and if T1<T0<T1, then Tm is obtained from the range from T0 to T2.

The optimal value thus obtained will be the optimal cooling-water temperature Tm at the present time step (i). The same calculation is repeated from step S0 onward so as to obtain the optimal value for the next time step Si+1 (step S13).

The optimal cooling-water temperature Tm obtained as described above is taken as the set cooling-water temperature serving as the controlling target value.

The set cooling-water temperature determined in the above way is sent to the control unit (not shown) of the cooling tower, and the rotation speed of the fan 19 or the rotation speed of the cooling water pump 16 is controlled so as to satisfy the set cooling-water temperature.

The above setting of the optimal cooling-water temperature Tm must be performed so as to satisfy the medium-temperature water set temperature range required by the external load. In other words, even when it is preferable to lower the cooling-water temperature to the prescribed value in order to minimize the power consumption, if the medium-temperature water set temperature range is not achieved, this optimal cooling-water temperature Tm will not be employed.

However, when there is no request for the medium-temperature water setting range from the external load, such as when heating is not required, the determination is made such that the power consumption of each of the heat pumps 1 and 51 is minimized regardless of the medium-temperature water set temperature range.

Figure 5:
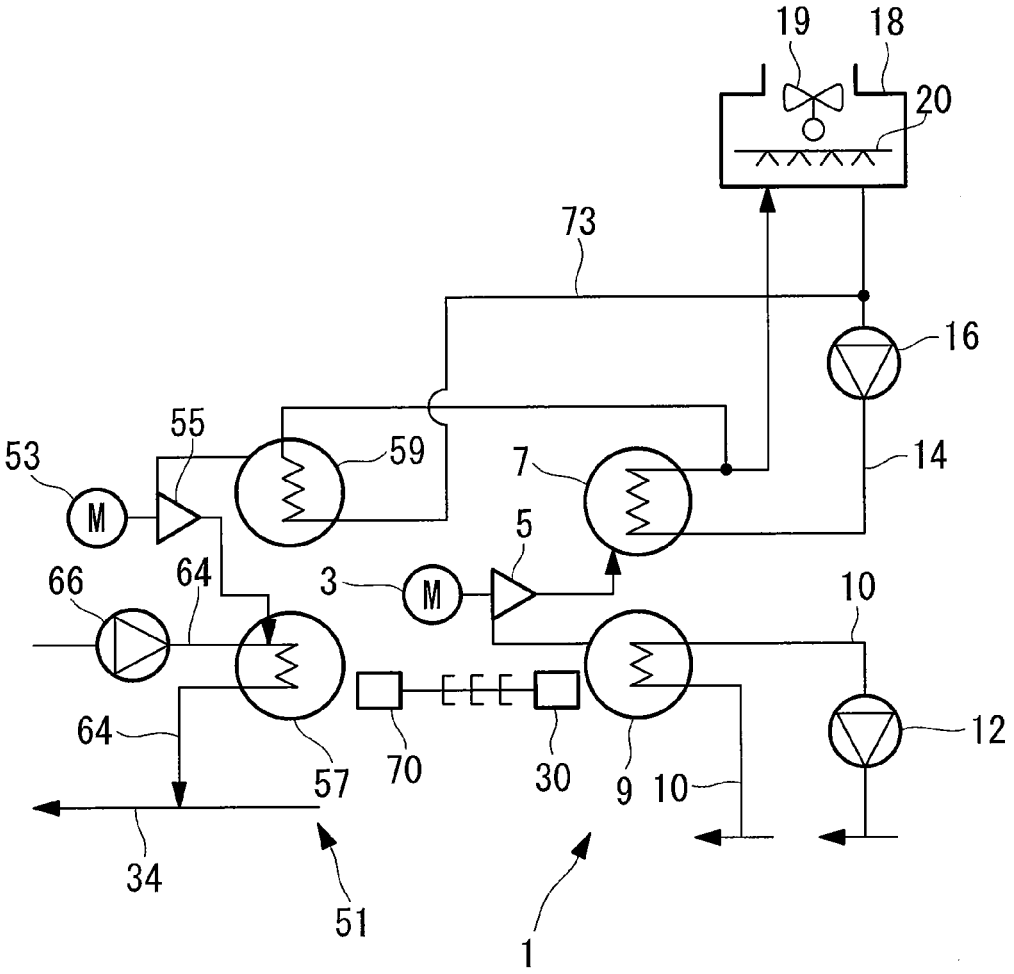
FIG. 5 is a schematic structural diagram showing a heat source system that does not perform the supply of medium-temperature water.

Such a setting method of the cooling-water temperature is also applicable to a heat source system where the output of the medium-temperature water is not required, as shown in FIG. 5. In the heat source system in FIG. 5, the medium-temperature-water heat exchanger 21, the medium-temperature-water supply piping 27, and so forth shown in FIG. 1 are omitted. Then, some of the cooling water which has removed the exhaust heat in the lower-stage condenser 7 is extracted by medium-temperature water extraction piping 73, is guided to the higher-stage evaporator 59, and is returned to the cooling water piping 14 upstream of the cooling water pump 16 after surrendering its heat to the higher-stage evaporator 59. Configurations that are identical to those in FIG. 1 are assigned the same reference numerals, and a description thereof is omitted.

As described above, according to this embodiment, the following effects and advantages are afforded.

In order to ensure the medium-temperature-water temperature required to obtain the desired high-temperature-water temperature, a lower limit of the cooling-water temperature is provided such that the required amount of lower-stage condenser 7 exhaust heat can be provided to the medium-temperature water. Therefore, the heat source system is operated at a cooling-water temperature that does not become lower than the lower-limit value. Thus, since the lower temperature limit of the cooling water is set on the basis of the set temperature of the high-temperature water, even when the low cooling-water temperature is required by the chilled-water main control heat pump 1, this request is restricted, and by ensuring the medium-temperature water of the desired temperature, the high-temperature water of the desired temperature can be output by the hot-water main control heat pump 51. In other words, not only are the high-temperature water and chilled water of the desired temperature obtained, but it is also possible to achieve both a medium-temperature-water temperature that is efficient for the hot-water main control heat pump 51 and a cooling-water temperature that is efficient for the chilled-water main control heat pump 1, and to realize a high energy efficiency of the heat source system as a whole.

Since the operating temperature of the cooling water is set considering the sum of the power consumptions of the chilled-water main control heat pump 1 and the hot-water main control heat pump 51, it is possible to realize energy-saving operation of the heat source system as a whole.

Figure 6:
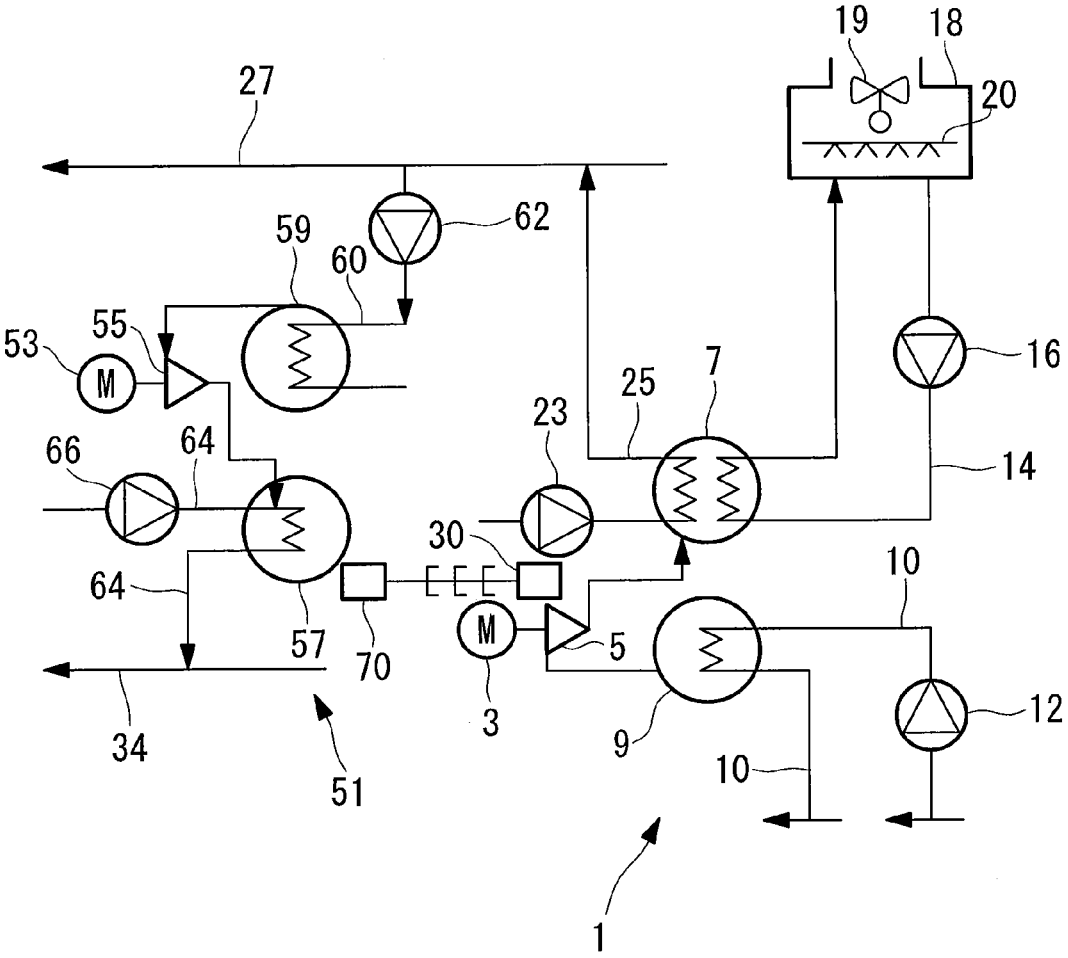
FIG. 6 is a schematic structural diagram showing a heat source system that employs a heat-recovery machine for a lower-stage condenser.
Figure 7:
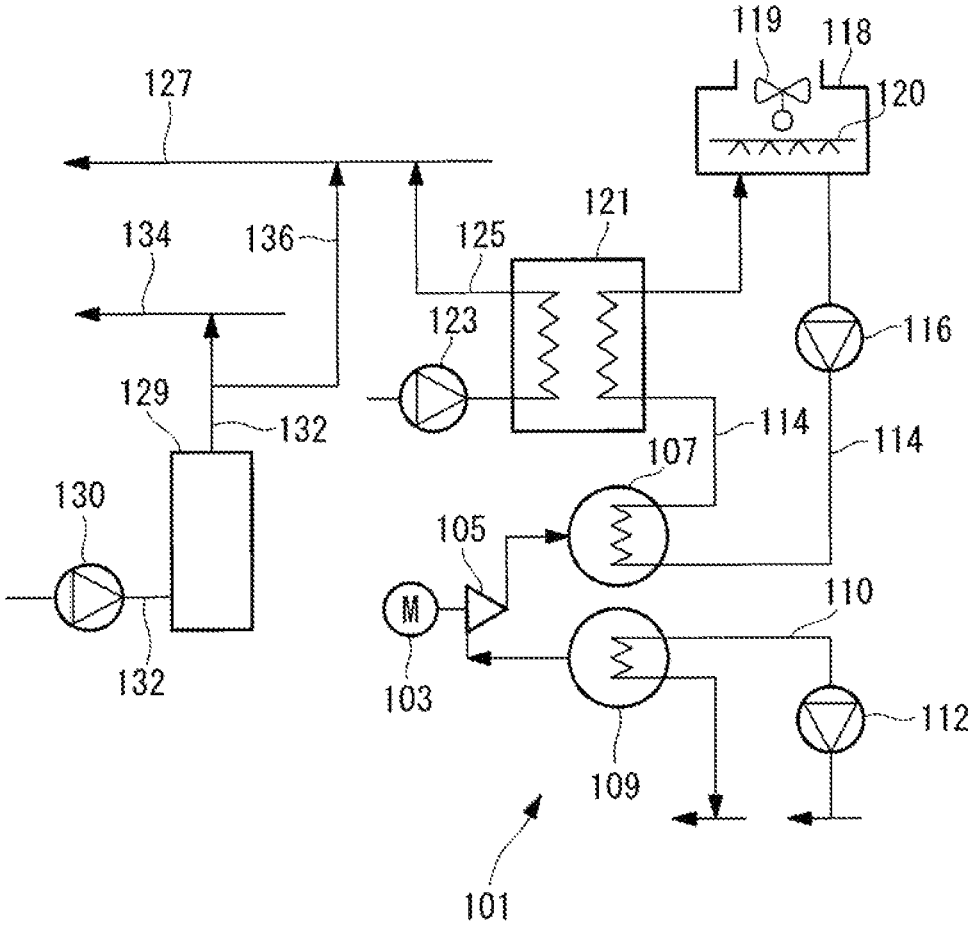
FIG. 7 (PRIOR ART)
FIG. 7 is a schematic structural diagram showing a conventional heat source system.
Figure 8:
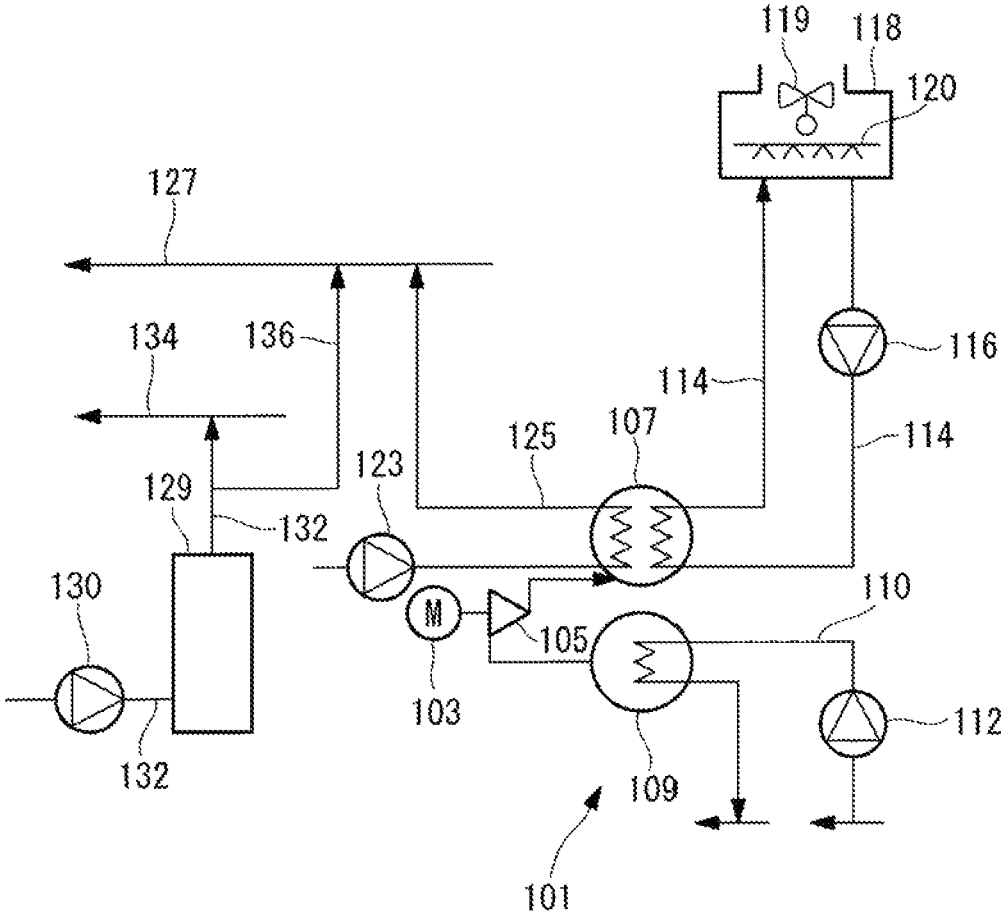
FIG. 8 (PRIOR ART)
FIG. 8 is a schematic structural diagram showing a heat source system that employs a heat-recovery machine for the heat source system in FIG. 7.

As shown in FIG. 6, instead of the heat source system of FIG. 1, a heat-recovery machine may be employed for the lower-stage condenser 7. The heat source system is configured such that the medium-temperature-water piping 25 is connected to the condenser 7, and heating is conducted by a medium-temperature-water heat exchanger (not shown) in the condenser 7, thereby obtaining heat from the condenser 7. In FIG. 6, configurations that are identical to those in FIG. 1 are assigned the same reference numerals, and a description thereof is omitted.

In this embodiment, although one heat source system has been described, the present invention is not limited thereto, and it is acceptable to employ a heat source system in which a plurality of heat source systems shown FIGS. 1, 5, and 6 are combined. In this case, a cooling tower common to each heat source system is preferably provided.

In this embodiment, although the calculation of the set cooling-water temperature is conducted by the lower-stage control unit 30, the present invention is not limited thereto, and the calculation may be conducted by the higher-stage control unit 70, or alternatively, an independent control unit may be provided.

In this embodiment, although a map or a numerical table is stored in the memory as the original data for the graph in FIG. 4, a prescribed arithmetic expression, with which the power consumption can be obtained from the cooling-water temperature according to each load, may be stored in the memory, and the cooling-water temperature may be derived from this arithmetic expression.

REFERENCE SIGNS LIST

1 chilled-water main control heat pump
5 lower-stage centrifugal compressor
7 lower-stage condenser
9 lower-stage evaporator
10 chilled water piping
14 cooling water piping
16 cooling water pump
18 cooling tower
21 medium-temperature-water heat exchanger
27 medium-temperature-water supply piping (medium-temperature-water output means)
51 hot-water main control heat pump
55 lower-stage centrifugal compressor
57 higher-stage condenser
59 higher-stage evaporator
64 high-temperature-water piping

The invention claimed is:

1. A heat source system comprising:

a chilled-water main control heat pump having a lower-stage evaporator that cools chilled water by a vaporization heat of refrigerant and a lower-stage condenser that dissipates a condensation heat of the refrigerant into cooling water, and outputting the chilled water cooled in the lower-stage evaporator to a first external load;

a hot-water main control heat pump having a higher-stage evaporator that evaporates the refrigerant with heat provided from medium-temperature water that has been heated with exhaust heat from the lower-stage condenser and a higher-stage condenser that heats high-temperature water with the condensation heat of the refrigerant, and outputting the high-temperature water heated in the higher-stage condenser to a second external load;

a lower-stage control unit that controls an operation of the chilled-water main control heat pump;

a higher-stage control unit that controls an operation of the hot-water main control heat pump;

a cooling tower that cools the cooling water by sprinkling the cooling water into outside air; and a cooling-water-temperature adjusting unit that is provided at the cooling tower and that adjusts a cooling-water temperature, wherein the lower-stage control unit sets a lower temperature limit of the cooling water on a basis of a set temperature of the high-temperature water that is sent from the high-stage control unit, wherein, when a percentage of a thermal load of the chilled-water main control heat pump relative to a thermal load of the hot-water main control heat pump is larger than a predetermined value, the lower-stage control unit sends a value of a lower limit of cooling-water temperature is used as a set temperature of the cooling-water to the cooling-water-temperature adjusting unit, and wherein the cooling-water-temperature adjusting unit is configured to control temperature of the cooling-water circulating in the cooling tower so as to satisfy the lower temperature limit.

2. A heat source system according to claim 1, further comprising:

medium-temperature-water output unit that outputs the medium-temperature water to the second external load, wherein an operating temperature of the cooling water is set within a medium-temperature-water set temperature range that is required by the medium-temperature-water output unit.

3. A heat source system according to claim 2, wherein, when there is no output-request to the medium-temperature-water output unit, the operating temperature of the cooling water is set regardless of the medium-temperature-water set temperature range.

4. A heat source system according to claim 2, wherein the operating temperature of the cooling water is set such that a sum of power consumed by the chilled-water main control heat pump and power consumed by the hot-water main control heat pump becomes substantially the minimum.

5. A heat source system according to claim 1, wherein the cooling-water temperature adjusting unit comprises a cooling water pump that controls the cooling-water temperature by adjusting a flow rate of the cooling water, a sprinkler that sprinkles the cooling water into outside air, and a fan that cools the sprinkled cooling water.

6. A control method of a heat source system that includes a chilled-water main control heat pump having a lower-stage evaporator that cools chilled water by the vaporization heat of refrigerant and a lower-stage condenser that dissipates the condensation heat of the refrigerant into cooling water, and outputting the chilled water cooled in the lower-stage evaporator to a first external load, and a hot-water main control heat pump having a higher-stage evaporator that evaporates the refrigerant with the heat given from medium-temperature water that has been heated with the exhaust heat from the lower-stage condenser and a higher-stage condenser that heats high-temperature water with the condensation heat of the refrigerant, and outputting the high-temperature water heated in the higher-stage condenser to a second external load, the control method comprising:

setting a lower temperature limit of the cooling water on the basis of a set temperature of the high-temperature water, and when a percentage of a thermal load of the chilled-water main control heat pump relative to a thermal load of the hot-water main control heat pump is larger than a predetermined value, setting a lower limit of cooling-water temperature as a set temperature of the cooling-water.

7. The control method of a heat source system according to claim 6, wherein the heat source system comprises a medium-temperature-water output unit that outputs the medium-temperature water to the second external load, and wherein an operating temperature of the cooling water is set within a medium-temperature-water set temperature range that is required by the medium-temperature-water output unit.

8. The control method of a heat source system according to claim 7, wherein, when there is no output-request to the medium-temperature-water output unit, the operating temperature of the cooling water is set regardless of the medium-temperature-water set temperature range.

9. The control method of a heat source system according to claim 7, wherein the operating temperature of the cooling water is set so that a sum of power consumed by the chilled-water main control heat pump and power consumed by the hot-water main control heat pump becomes substantially the minimum.

10. The control method of a heat source system according to claim 6, wherein the heat source system comprises:

a cooling tower that cools the cooling water by sprinkling the cooling water into outside air, and a cooling-water-temperature adjusting unit that is provided at the cooling tower and that adjusts a cooling-water temperature, and wherein the cooling-water-temperature adjusting unit controls temperature of the cooling-water by adjusting a flow rate of the cooling water.

* * * * *